US005826467A

United States Patent [19]

Huang

[11] Patent Number: 5,826,467

[45] Date of Patent: Oct. 27, 1998

[54] EASY SHIFT SNAP RING PLIERS

[76] Inventor: Hsin Te Huang, No. 11, 35th Road, Gong Yeh Chu, Taichung, Taiwan

[21] Appl. No.: 837,554

[22] Filed: Apr. 21, 1997

[51] Int. Cl.[6] ..... B25B 7/12

[52] U.S. Cl. ..... 81/302; 29/229

[58] Field of Search ..... 81/302, 486, 416; 29/225, 229

[56] References Cited

U.S. PATENT DOCUMENTS 3,826,160 7/1974 Allen et al. .
4,793,224 12/1988 Huang .
5,007,313 4/1991 Jeromson et al. ..... 81/302 X
5,065,650 11/1991 Anderson et al. ..... 81/302 X

*Primary Examiner*—James G. Smith

[57] ABSTRACT

A pair of snap ring pliers for engaging with different retaining rings include a pair of handles pivotally coupled together at a hub having an aperture. A pair of jaws are pivotally coupled together at a shaft which is slidably engaged in the aperture and adapted to be moved between an upper position and a lower position. A positioning member has a lower chamber and an upper chamber for engaging with the shaft and for allowing the shaft to be moved between the chambers and for allowing the jaws to engage with different retaining rings.

7 Claims, 4 Drawing Sheets

EASY SHIFT SNAP RING PLIERS

BACKGROUND OF THE INVENTION

1. Field of the Invention

The present invention relates to a tool, and more particularly to a pair of easy shift snap ring pliers.

2. Description of the Prior Art

The closest prior art of which applicant is aware is his prior U.S. Pat. No. 4,793,224 to Huang, issued on Dec. 27, 1988. The retaining ring fitting tool is also suitable for engaging with different retaining rings. However, the tool requires to disengage the studs in order to change the operation types of the tool. U.S. Pat. No. 3,826,160 to Allen et al. discloses a clamping tool having a pair of jaws that may be moved relative to the handles. However, the handles are all pivotally coupled together by a pin which has no opening for allowing a shaft slidably engaged therein.

The present invention has arisen to mitigate and/or obviate the afore-described disadvantages of the conventional retaining ring fitting tools.

SUMMARY OF THE INVENTION

The primary objective of the present invention is to provide a retaining ring fitting tool which can be easily adjusted to different operational types for engaging with different type of fitting rings.

In accordance with one aspect of the invention, there is provided a pair of snap ring pliers for engaging with different retaining rings, the pliers comprises a pair of handles including an upper portion pivotally coupled together at a hub, the hub including an aperture, the handles each including an upper pin arranged above the aperture and each including a lower pin arranged below the aperture, a pair of jaws including a lower portion pivotally coupled together at a shaft, the shaft being slidably engaged in the aperture and adapted to be moved between an upper position and a lower position, the jaws each including a bottom portion having a notch for engaging with the lower pin and each including a middle portion having a guide channel for engaging with the upper pin, the guide channels each including an upper curved slot and a lower curved slot for engaging with the upper pins, and means for positioning the shaft in the lower position and for allowing the shaft to be moved to the upper position. The notches are engaged with the lower pins for allowing the jaws to be moved away from each other when the shaft is positioned in the lower position and when the handles are moved toward each other, and the notches are disengaged from the lower pins and the upper pins are engaged with the lower curved slots of the jaws for allowing the jaws to be moved toward each other when the shaft is positioned in the upper position and when the handles are moved toward each other.

The positioning means includes a lower chamber for retaining the shaft in the lower position and includes an upper chamber for retaining the shaft in the upper position. The positioning means includes two neck portions provided between the lower chamber and the upper chamber for allowing the shaft to be moved from the lower chamber to the upper chamber. The positioning means is engaged in the aperture of the hub and is substantially M-shaped having two resilient blades for increasing the resilience of the neck portions. A pair of discs are further engaged beside the hub for retaining the positioning means in place and for preventing the positioning means from being disengaged from the hub.

A spring member is further provided for biasing the jaws toward the handles and for securing the jaws to the handles.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
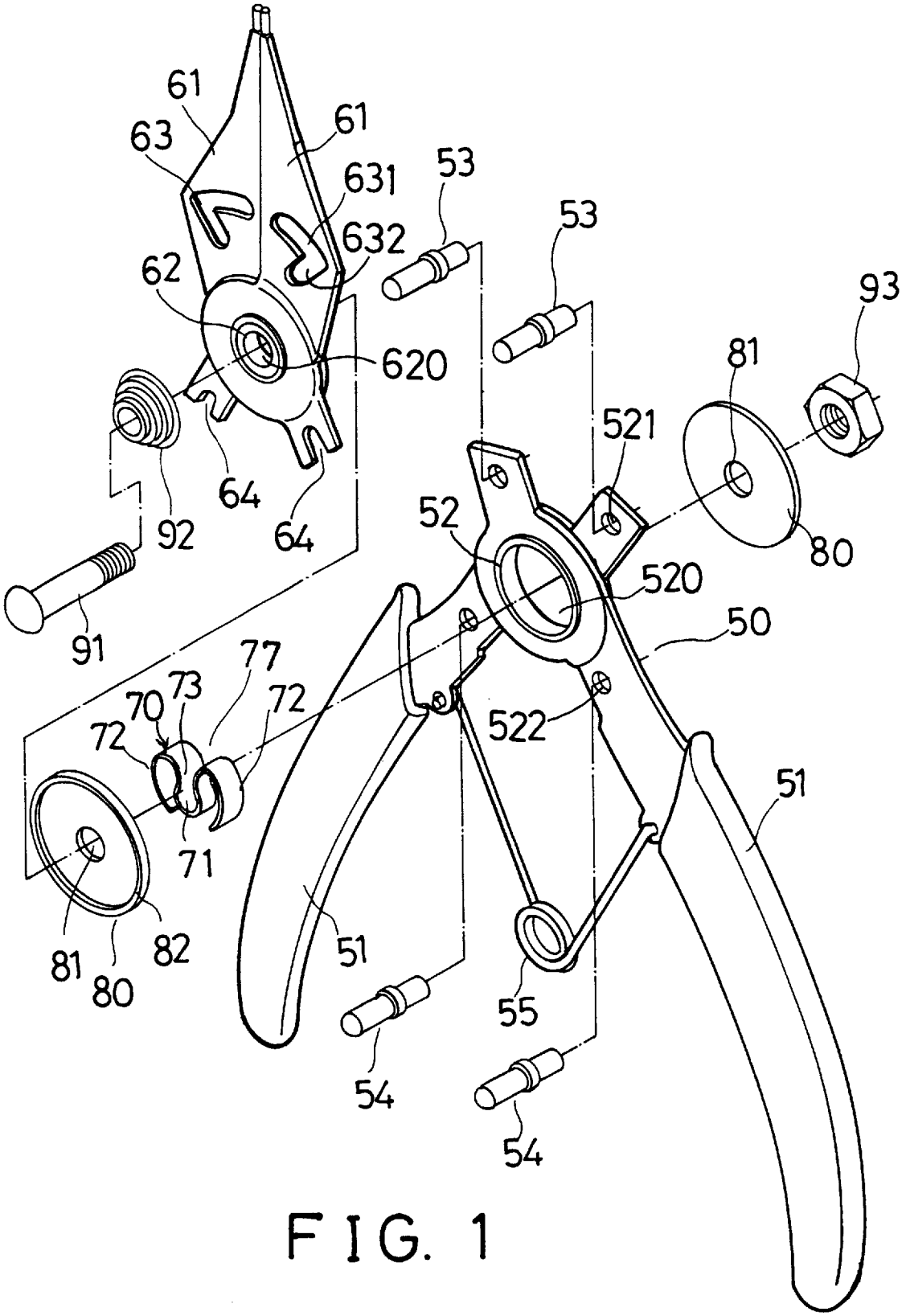
FIG. 1 is an exploded view of a pair of snap ring pliers in accordance with the present invention.
Figure 2:
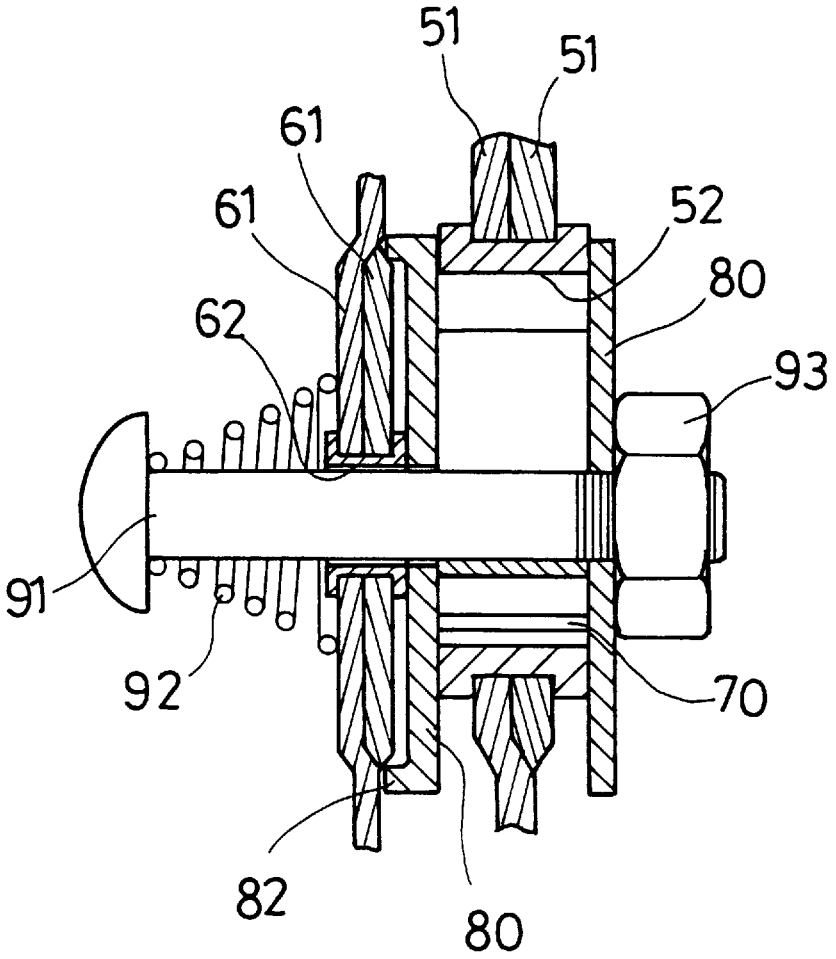
FIG. 2 us a cross sectional view taken along lines 2—2 of FIG. 3.
Figure 3:
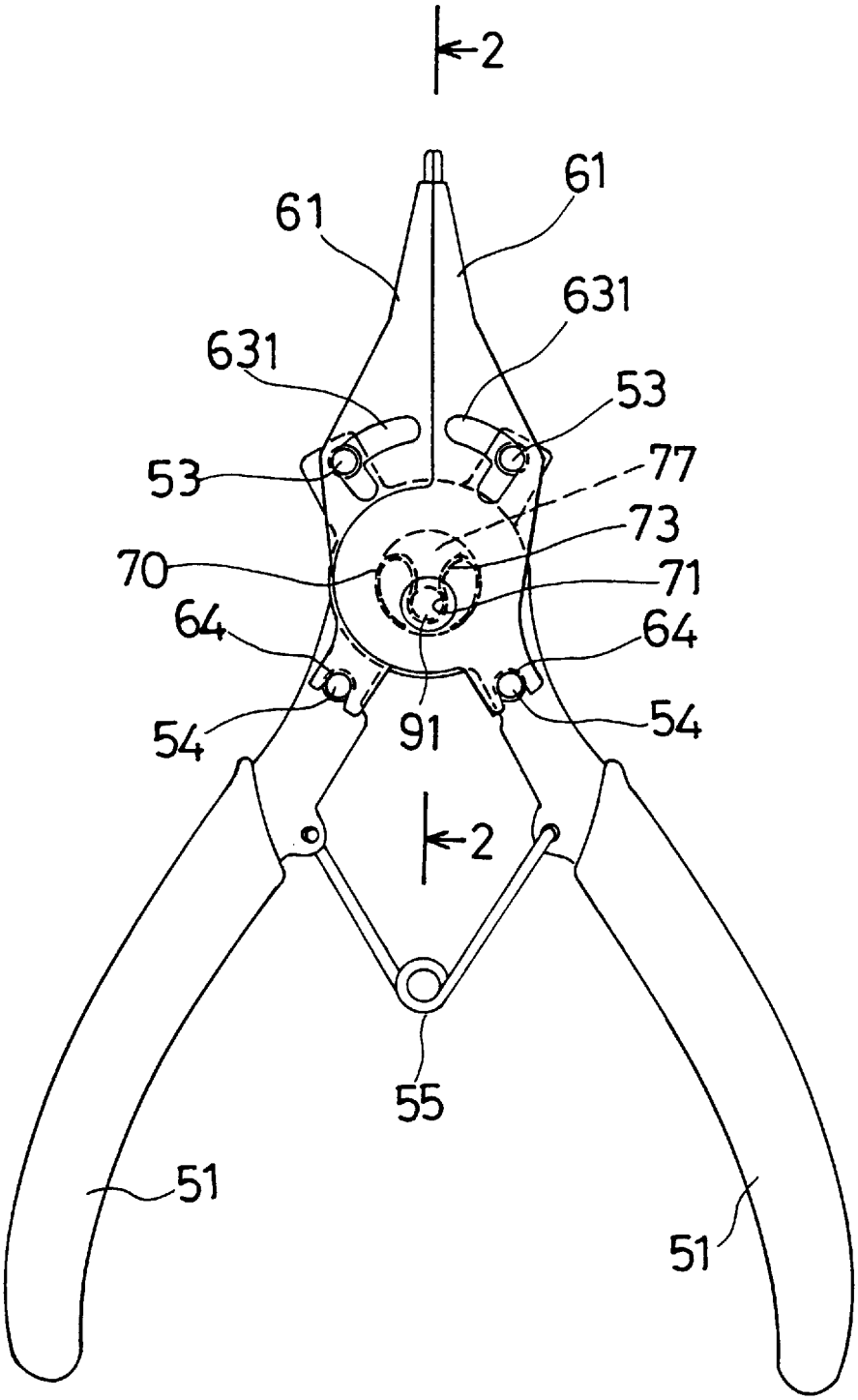
FIGS. 3 and 4 are plane views illustrating the operations of the pliers.

Referring to the drawings, and initially to FIGS. 1 to 3, a pair of snap ring pliers in accordance with the present invention comprises a pair of handles 51 having an upper portion pivotally coupled together at a hub 52 which includes an aperture 520. A spring 55 is provided for biasing the handles 51 away from each other. The pair of handles 51 each includes two holes 521 and 522 arranged above and below the aperture 520 for engaging with pins 53, 54 respectively. A pair of discs 80 are engaged beside the hub 52 and each includes a hole 81.

A pair of jaws 61 include a lower portion pivotally coupled together at a ring 62 which includes an orifice 620 for engaging with a bolt or a shaft 91 which has a threaded end for engaging with a nut 93 for securing the elements together. The shaft 91 is engaged through the holes 81 of the discs 80 for securing the handles 51 and the jaws 61 together. The jaws 61 each includes a guide channel 63 having an upper curved slot 631 and a lower curved slot 632, and each includes a notch 64 formed in the bottom for engaging with the pins 54 respectively. A spring 92 is engaged on the shaft 91 for biasing the jaws 61 toward and to engage with the handles 51 (FIG. 2 ). The disc 80 disposed between the handles 51 and the jaws 61 includes a peripheral flange 82 for engaging with the jaws 61 (FIGS. 1 and 2), and for allowing the jaws 61 to be arranged parallel to the handles 51 (FIG. 2).

An M-shaped resilient positioning member 70 includes a pair of necks 73 formed in the center portion for defining a lower chamber 71 and an upper chamber 77 (FIGS. 1, 3, 4), and includes a pair of resilient blades 72 for increasing the resilience of the necks 73 which are provided for engaging with the shaft 91. The positioning member 70 is engaged in the aperture 520 of the hub 52 and is retained in place by the discs 80.

In operation, as shown in FIG. 3, when the shaft 91 is engaged in the lower chamber 71 of the positioning member 70, the notches 64 of the jaws 61 are engaged with the pins 54. At this moment, the jaws 61 are secured to the handles 51 such that the jaws 61 may be moved away from each other when the handles 51 are moved toward each other and such that the jaws 61 may be provided for moving the end portions of a retaining ring away from each other. The pins 53 may slide along the upper curved slots 631.

Figure 4:
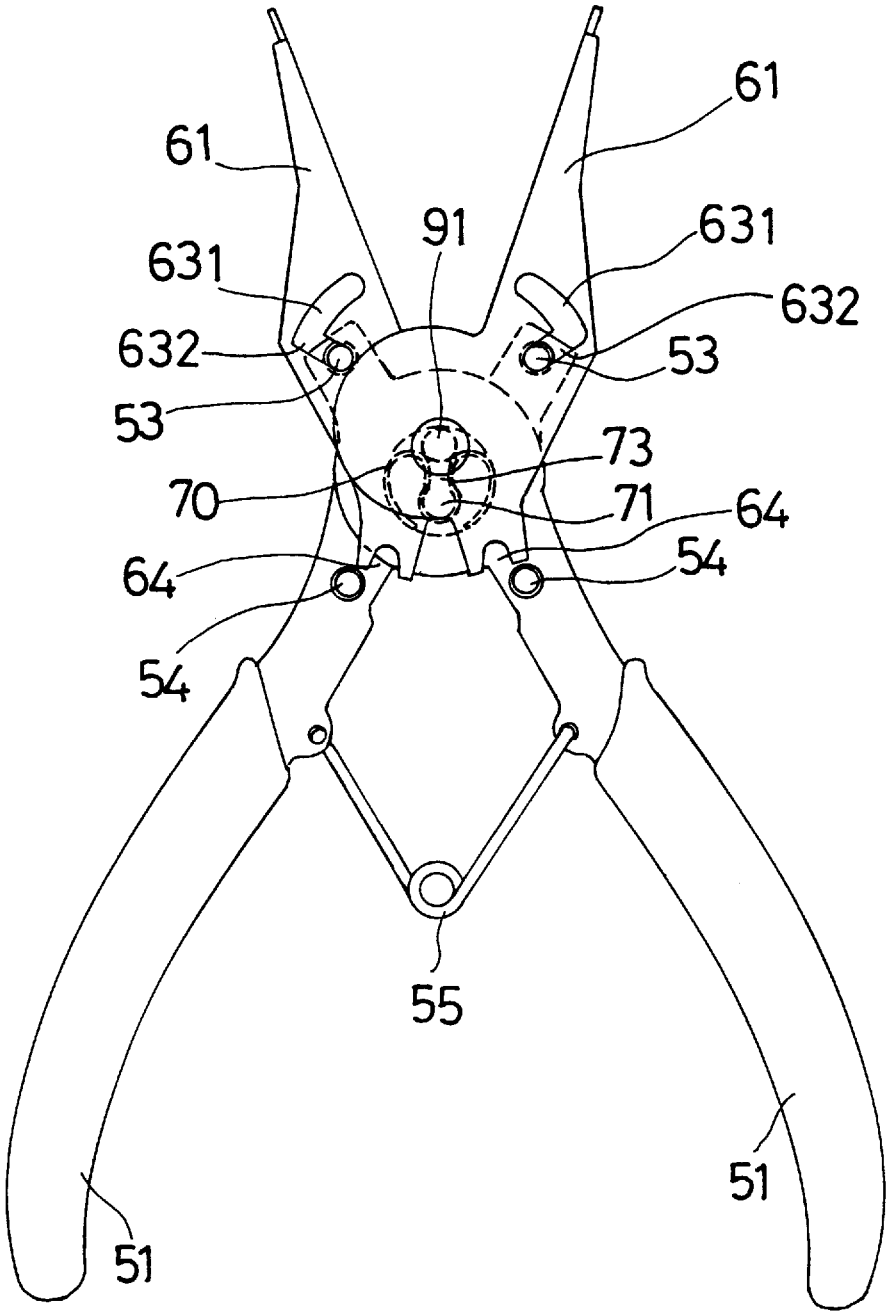

Referring next to FIG. 4, when the shaft 91 is engaged with the upper chamber 77, the notches 64 are disengaged from the pins 54 and the pins 53 are engaged with the lower curved slots 632 such that the jaws 61 may be moved toward each other when the handles 51 are moved toward each other and such that the jaws 61 may be provided for moving the end portions of a retaining ring toward each other.

It is to be noted that the hub 52 includes an aperture 520 for engaging with the positioning member 70 which includes an upper chamber 77 and a lower chamber 71 for engaging with the shaft 91 and for positioning the shaft 91 in either of the upper or the lower chamber. The shaft 91 is thus slidably engaged in the aperture 520 for allowing the jaws 61 to be easily moved upward or downward to engage with different retaining rings.

Accordingly, the snap ring pliers in accordance with the present invention include a pair of jaws that may be moved either toward or away from each other when the handles are moved toward each other and can be easily adjusted to engage with different retaining rings without disengaging the jaws from the handles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A snap ring pliers for engaging with different retaining rings, said pliers comprising:

a pair of handles including an upper portion pivotally coupled together at a hub, said hub including an aperture, said handles each including an upper pin arranged above said aperture and each including a lower pin arranged below said aperture, a pair of jaws including a lower portion pivotally coupled together at a shaft, said shaft being slidably engaged in said aperture and adapted to be moved between an upper position and a lower position, said jaws each including a bottom portion having a notch for engaging with said lower pin and each including a middle portion having a guide channel for engaging with said upper pin, said guide channels each including an upper curved slot and a lower curved slot for engaging with said upper pins, and means for positioning said shaft in said lower position and for allowing said shaft to be moved to said upper position, said notches being engaged with said lower pins for allowing said jaws to be moved away from each other when said shaft is positioned in said lower position and when said handles are moved toward each other, and said notches being disengaged from said lower pins and said upper pins being engaged with said lower curved slots of said jaws for allowing said jaws to be moved toward each other when said shaft is positioned in said upper position and when said handles are moved toward each other.

2. A pair of pliers according to claim 1, wherein said positioning means includes a lower chamber for retaining said shaft in said lower position and includes an upper chamber for retaining said shaft in said upper position.

3. A pair of pliers according to claim 2, wherein said positioning means includes a neck portion provided between said lower chamber and said upper chamber for allowing said shaft to be moved from said lower chamber to said upper chamber.

4. A pair of pliers according to claim 3, wherein said positioning means includes at least one resilient blade for increasing a resilience of said neck portion.

5. A pair of pliers according to claim 2, wherein said positioning means is engaged in said aperture of said hub.

6. A pair of pliers according to claim 5 further comprising a pair of discs engaged beside said hub for retaining said positioning means in place.

7. A pair of pliers according to claim 1 further comprising means for biasing said jaws toward said handles.

* * * * *